US007198135B2

(12) United States Patent
Naber

(10) Patent No.: US 7,198,135 B2
(45) Date of Patent: Apr. 3, 2007

(54) LIFTING DEVICE, ESPECIALLY LIFTING PLATFORM FOR MOTOR VEHICLES

(75) Inventor: Wolfgang Naber, Neuenkirchen (DE)

(73) Assignee: autop Maschinenbau GmbH, Rheine (DE)

( * ) Notice: Subject to any disclaimer, the term of this patent is extended or adjusted under 35 U.S.C. 154(b) by 265 days.

(21) Appl. No.: 10/926,093

(22) Filed: Aug. 26, 2004

(65) Prior Publication Data

US 2006/0042877 A1 Mar. 2, 2006

(51) Int. Cl.
*B66F 7/16* (2006.01)

(52) U.S. Cl. ..... 187/215; 187/203; 187/210; 187/213; 187/274; 187/414; 254/89 H; 254/89 R; 92/86.5; 92/169.1; 92/169.3; 60/413

(58) Field of Classification Search ..... 187/205, 187/210, 213, 215, 274, 414; 254/89 R, 254/89 H; 92/51, 86.5, 163, 169.1, 169.3; 137/625; 91/406; 60/584
See application file for complete search history.

(56) References Cited

U.S. PATENT DOCUMENTS 3,053,050 A * 9/1962 Sommerer ..... 60/478

FOREIGN PATENT DOCUMENTS

DE 200 12 375 2/2001
JP 06042670 A * 2/1994

* cited by examiner

*Primary Examiner*—Eileen D. Lillis
*Assistant Examiner*—Stefan H Kruer
(74) *Attorney, Agent, or Firm*—Gudrun E. Huckett

(57) ABSTRACT

A lifting platform for motor vehicles has at least one extendable lifting column that is formed by a tubular jacket and a lifting cylinder unit arranged at least partially therein. The upper end of the lifting cylinder unit supports a load receptacle. The tubular jacket and the lifting cylinder unit are air-tightly connected to one another and form a compressed air storage chamber between the inner wall of the tubular jacket and the outer wall of the lifting cylinder unit. The compressed air storage chamber is provided with a compressed air supply connector and, in the upper end area, with a compressed air outlet connector. The lifting device is preferably an underfloor lifting platform with hydraulic cylinders. A check valve is arranged in the filling direction upstream of the compressed air supply connector.

16 Claims, 3 Drawing Sheets

LIFTING DEVICE, ESPECIALLY LIFTING PLATFORM FOR MOTOR VEHICLES

BACKGROUND OF THE INVENTION

The invention relates to a lifting device, in particular, a lifting platform for motor vehicles, comprising at least one extendable lifting column that is comprised of a tubular jacket and a lifting cylinder unit arranged at least partially therein and whose upper end supports a load receptacle.

In practice, such lifting platforms are comprised of one or several telescoping lifting columns having at their upper free ends a load receptacle configured in the form of a running rail or in a different way. The lifting columns can be extended by means of lifting cylinder units that are arranged in a tubular jacket, respectively. The tubular jacket serves in this connection for receiving and compensating differential moments, for example, bending moments, resulting from non-uniform load distribution that are introduced through the load receptacle. The pressure forces, on the other hand, are applied or received by the lifting cylinder units. Moreover, the tubular jacket is provided for protecting the lifting cylinder units.

For various labor tasks to be performed on the motor vehicles to be lifted, it is advantageous to provide in the upper end area of the lifting column a compressed air connector so that required compressed air, for example, for pneumatic screwdrivers or for cleaning components can be tapped directly in the vicinity of the working position. In this way, long compressed air hoses that always present a tripping hazard are no longer required in the workshop.

In DE 200 12 375 a lifting platform is disclosed that comprises an energy supply connector, for example, for compressed air, on running rails or load receptacles. In the lifting platform described therein, a conduit element, for example, for compressed air, extends through the tubular jacket. The farther this lifting platform and thus also the conduit element is removed from the connected compressor, the more frequent problems occur, when, for example, impact wrenches require instantaneously a lot of compressed air for detaching seized wheel nuts, which compressed air, however, is not available in sufficient quantity with such a conduit configuration. Moreover, the conduits that extends to the consumer often have a small cross-section because of the minimal mounting space that is available, and this leads to additional losses.

SUMMARY OF THE INVENTION

The invention therefore concerns the problem of providing a lifting device having a simplified configuration through which instantaneously even a great amount of compressed air can be made available.

This object is solved by a lifting device wherein the tubular jacket and the lifting cylinder unit are air-tightly connected to one another and form a compressed air storage chamber between the inner wall of the tubular jacket and the outer wall of the lifting cylinder unit. The compressed air storage chamber is provided with a compressed air supply connector and, in the upper end area, with a compressed air outlet connector.

By providing a compressed air storage chamber between the tubular jacket and the lifting cylinder unit with an air-tight connection therebetween, long supply lines with narrow cross-sections are not needed because the compressed air can be guided through the cavity between the tubular jacket and the lifting cylinder unit. The provided pressure storage device is beneficially arranged near the consumer. Between the pressure storage device in the lifting column and the consumer, only approximately two meters of hose conduit are required for ergonomic working. Since pneumatic tools generally are used only for short periods of time, there is always sufficient time between the periods of use for completely refilling the compressed air storage device. Accordingly, it is generally possible to select a smaller workshop compressor, and, despite of this, a sufficient amount of compressed air is available near the consumer location without great losses in the conduits.

BRIEF DESCRIPTION OF THE DRAWINGS

Further advantages and details result from the dependent claims and the embodiment illustrated in the drawing to be described in the following. It is shown in:

DESCRIPTION OF PREFERRED EMBODIMENTS

Figure 1:
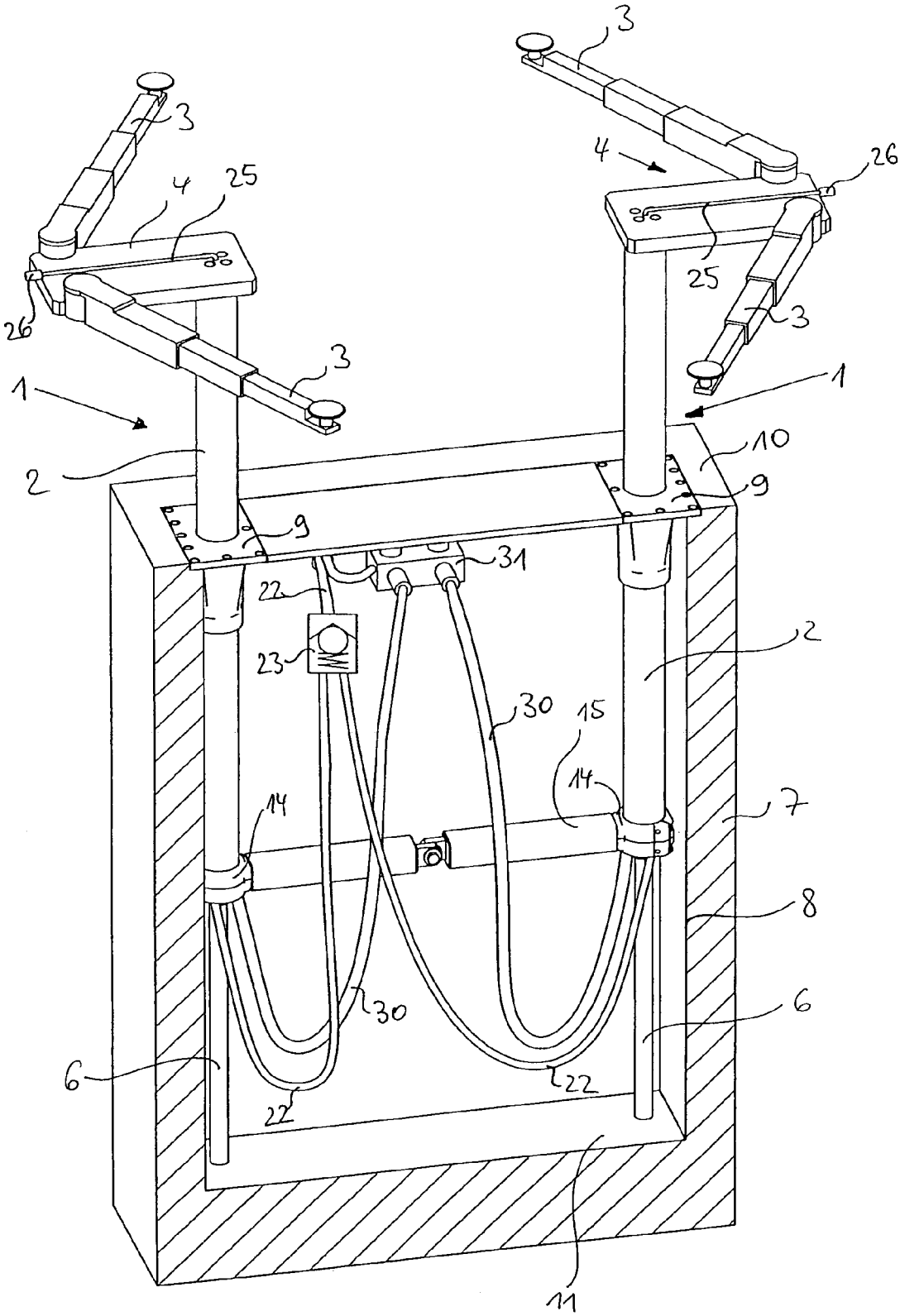
FIG. 1 a platform according to the invention in its entirety.
Figure 2:
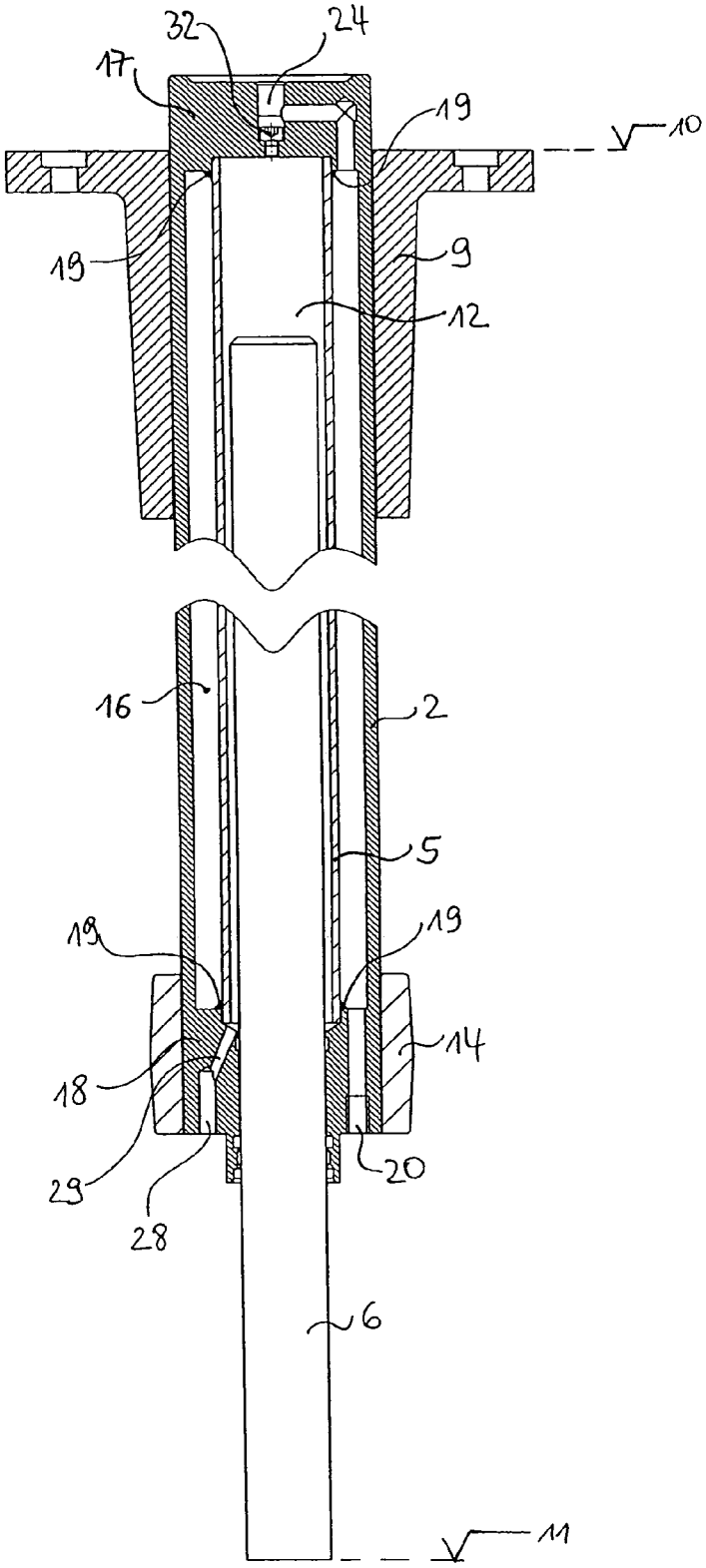
FIG. 2 a longitudinal section of one of the two lifting columns of the item of FIG. 1.
Figure 3:
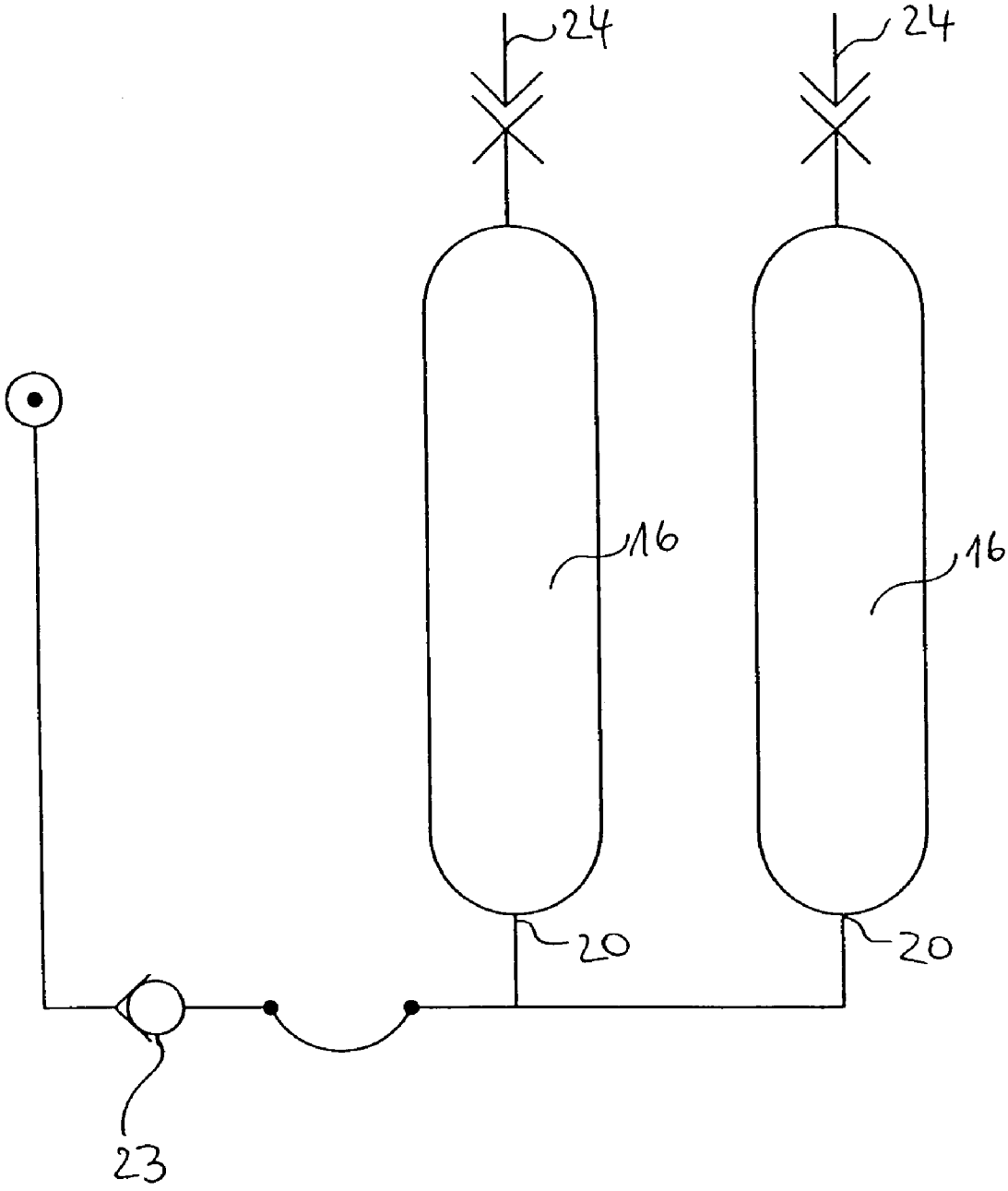
FIG. 3 a schematic pneumatic circuit diagram of the lifting platform of FIG. 1.

The illustrated lifting device is a lifting platform for motor vehicles with two parallel telescoping lifting columns 1. Each lifting column 1 has a tubular jacket 2 that supports on its topside a load receptacle 4 provided with two swivel arms 3. As illustrated in FIG. 2, the tubular jacket 2 surrounds an outer cylinder 5 that forms together with the piston 6 that is moveable in the cylinder a lifting cylinder unit. As illustrated, the lifting platform according to the invention is used preferably as an underfloor platform. For illustration purposes, the workshop underfloor 7 in FIG. 1 is shown in section. In the workshop underfloor 7, that forms at the same time a foundation, a mounting compartment 8 is provided. The tubular jackets 2 can be extended or lowered through guides 9 relative to workshop floor 10. For this purpose, the pistons 6 of the lifting cylinder units are supported at their lower ends on the foundation floor 11. By filling the lifting cylinder interior 12, the outer cylinders 5 together with the tubular jackets 2 can be extended. In order to ensure a uniform extension movement and return movement, the tubular jackets 2 are connected to one another to form an essentially rigid arrangement by a synchronizing lever 15 and clamps 14.

For configuring in accordance with the present invention the compressed air storage chamber 16 between the tubular jacket 2 and the lifting cylinder unit, in the illustrated embodiment the outer cylinder 5 is connected to the tubular jacket 2 in an airtight manner. Preferably, this connection is realized at a piston lid 17 at the upper end of the tubular jacket 2 and a piston guide 18 at the lower end of the tubular jacket 2. The airtight connection is configured in a simple way preferably by a fixed material connection such as weld seams 19, adhesive connections, press fit connections or the like. The compressed air storage chamber 16 is formed by the annular space between the inner wall of the tubular jacket 2 and the outer wall of the outer cylinder 5 and preferably can be filled with compressed air by means of a compressed air connector 20 arranged in the piston guide 18. The compressed air supply connectors 20 are to be connected by pneumatic lines 22 to a compressor (not illustrated) or, for example, to a compressed air network system of the workshop, respectively. The configuration of the lifting device as an underfloor lifting platform and the position of the compressed air supply connectors 20 enable a beneficial and secure arrangement of the compressed air conduits 22 in the mounting compartment 8 underneath the plane of the workshop floor 10. Preferably, between the compressed air supply connectors 20 and the compressor or the compressed air network system of the workshop, a pneumatic check valve 23, only schematically illustrated, is provided which can also be arranged in the mounting compartment 8.

For transferring the compressed air stored in the compressed air storage device 16 to a consumer, for example, a pneumatic screwdriver or pneumatic gun, at the topside of the tubular jacket 2 a compressed air outlet connector 24 is provided. It can be arranged preferably on the piston lid 17. In order to reduce the need for flexible and easily damaged compressed air conduits even more, the compressed air outlet connector 24, as illustrated in FIG. 1, is connected preferably to an air outlet line 25 that is provided with a connector coupling 26, preferably a quick coupling, for the compressed air consumer. Preferably, this connector coupling 26 is to be arranged in an easily accessible area on the load receptacle 4.

The lifting cylinder units, as illustrated, are preferably hydraulic cylinders. The supply of the hydraulic oil is realized through a hydraulic oil connector 28 in the piston guide 18 from where a hydraulic oil supply channel 29 extends to the lifting cylinder interior 12. The hydraulic oil lines 30 extend from the hydraulic oil connectors 28 in the mounting compartment 8 to a pump 31. A venting element 32 for venting the lifting cylinder interior 12 of the hydraulic cylinder can be arranged in a simple way in the compressed air outlet connector 24.

When the tubular jacket 2 is provided with an inner diameter of approximately 120 mm and a wall thickness of approximately 10 mm, for an outer diameter of the outer cylinder 5 of approximately 80 mm and a conventional lifting height of each lifting column of a lifting platform a pressure storage volume of approximately 12 to 14 liters can be provided. The compressed air storage device 16 is to be filled with approximately 6 to 8 bar. For this purpose, it is not required to employ materials that are especially strong, far in excess of conventional materials, because the tubular jacket 2 must be configured anyway so as to be able to receive high forces and the outer cylinder 5 must be configured to receive high pressures caused by the hydraulic oil.

Because of the configuration of a compressed air storage chamber 16 in the lifting column in accordance with the present invention, a decoupling of the compressed air consumer from the workshop network system or the supply compressor is realized. The compressed air storage chamber 16 and the pressure to be provided are large enough for compensating fluctuations between removal of and refilling with compressed air.

The afore described configuration is to be understood simply as an example. A person skilled in the art is at liberty to select other suitable configurations and dimensions that appear to be suitable for the application in question.

What is claimed is:

1. A lifting device comprising:

at least one extendable lifting column comprised of a tubular jacket, a lifting cylinder unit arranged at least partially in the tubular jacket, and a load receptacle connected to an upper end of the lifting cylinder unit;

wherein the tubular jacket and the lifting cylinder unit are air-tightly connected to one another and form a compressed air storage chamber between an inner wall of the tubular jacket and an outer wall of the lifting cylinder unit;

wherein the compressed air storage chamber is provided with a compressed air supply connector and has an upper end area provided with a compressed air outlet connector.

2. The lifting device according to claim 1 formed as an underfloor lifting platform.

3. The lifting device according to claim 1, wherein the compressed air supply connector is arranged in a lower end area of the tubular jacket.

4. The lifting device according to claim 1, further comprising a piston lid arranged at an upper end of the tubular jacket, wherein the compressed air outlet connector is arranged in the piston lid.

5. The lifting device according to claim 1, further comprising:

a piston guide arranged at a lower end area of the tubular jacket, wherein the compressed air supply connector is provided in the piston guide;

a piston lid arranged at an upper end of the tubular jacket, wherein the compressed air outlet connector is provided in the piston lid;

wherein the lifting cylinder unit comprises a piston and an outer cylinder at least partially surrounding the piston, wherein the outer cylinder is fixedly materially connected to the piston guide and to the piston lid.

6. The lifting device according to claim 1, wherein the lifting cylinder unit is a hydraulic cylinder.

7. The lifting device according to claim 1, further comprising an air outlet line having a connector coupling for a compressed air consumer and being connected to the compressed air outlet connector.

8. The lifting device according to claim 1, wherein the compressed air supply connector is configured to be connected to a compressor.

9. The lifting device according to claim 1, wherein the compressed air supply connector is configured to be connected to a compressed air network system.

10. The lifting device according to claim 1, further comprising a pneumatic check valve arranged upstream of the compressed air supply connector.

11. The lifting device according to claim 1 in the form of a lifting platform for motor vehicles.

12. The lifting device according to claim 1, wherein the compressed air outlet connector supplies compressed air to an external compressed air consumer.

13. The lifting device according to claim 3, further comprising a piston guide arranged at the lower end area of the tubular jacket, wherein the compressed air supply connector is arranged in the piston guide.

14. The lifting device according to claim 3, wherein the lifting cylinder unit is a hydraulic cylinder, wherein the piston guide comprises a hydraulic oil connector and a hydraulic oil supply channel extending to the hydraulic cylinder.

15. The lifting device according to claim 6, wherein the compressed air outlet connector comprises a venting element for the hydraulic cylinder.

16. The lifting device according to claim 7, wherein the connector coupling is arranged on the load receptacle.

* * * * *